United States Patent [19]

Alvey

[11] 4,309,036

[45] Jan. 5, 1982

[54] METHOD OF PLAYING A COMBAT SIMULATING BOARD GAME

[76] Inventor: Roscoe D. Alvey, Rte. 4, Harrisburg, Ill. 62946

[21] Appl. No.: 182,435

[22] Filed: Aug. 29, 1980

[51] Int. Cl.[3] ..... A63F 3/00

[52] U.S. Cl. ..... 273/248; 273/255; 273/261

[58] Field of Search ..... 273/243, 248, 249, 253, 273/261, 262

[56] References Cited

U.S. PATENT DOCUMENTS

| | | | |
|---|---|---|---|
| 796,774 | 8/1905 | Thompson | 273/255 |
| 1,406,691 | 2/1922 | Sewell | 273/249 |
| 1,572,254 | 2/1926 | Tornes | 273/249 |
| 1,615,927 | 2/1927 | Atkinson | 273/248 |
| 3,951,410 | 4/1976 | McNeil | 273/255 |
| 4,211,420 | 7/1980 | Quiroz | 273/260 |

*Primary Examiner*—Anton O. Oechsle

*Attorney, Agent, or Firm*—Rogers, Eilers & Howell

[57] ABSTRACT

An apparatus and method for playing a board game includes a playing board having a playing surface comprised of five concentric rings, each ring being divided into eight game piece areas. A circle in the center of the playing surface is divided into two semi-circles and define the inner fortress for each player. Each ring has two designated game piece areas for each player which indicate the position at which game pieces advance into the next innermost ring and the initial game piece area moved into to start movement about that ring. Each player's designated areas are on opposite sides of the ring from the other player to eliminate congestion and enhance play. Each player is assigned a plurality of game pieces including warriors, scouts, archers, shield bearers, captains, and one king. A catapult is available to each player as a means of capturing opposing game pieces. Opposing game pieces may also be captured by the archer and by the winning of "battles" which occur when one or more player's game pieces land on a game piece area occupied by one or more of the other player's game pieces. Movement is controlled by the rolling of dice and the game pieces successively traverse the rings as they move towards the inner fortress. The object of the game is to be the first player to move his king around the concentric rings and into the inner fortress.

9 Claims, 2 Drawing Figures

METHOD OF PLAYING A COMBAT SIMULATING BOARD GAME

BACKGROUND AND SUMMARY

Board games are a favorite form of entertainment for a wide variety of people and their popularity has been steadily increasing over the years. Many of the more popular include a playing board having a playing surface with each player moving a group of his own game pieces across the board in some manner, possibly in response to the throwing of a pair of dice. The more successful games take on a particular theme with the game pieces and playing surface reflecting the theme chosen. In some games, the movement of the game pieces fits in with the theme, which helps to bring the theme to life and enhance the playing of the game.

Accordingly, applicant has succeeded in developing and designing a board game with apparatus and a method of play which simulates an ancient form of combat utilizing spear carrying warriors, archers, shield bearers, and even a catapult. The game pieces are miniature statuettes formed into shapes resembling their identity and their mode of play. The playing surface takes on the shape of an inner fortress surrounded by a series of rings and pits one player's game pieces against the other by establishing "stations" and "barricades" to block the advance of a king to the inner fortress. Opposing game pieces may be captured by archers who camp along a ring and may shoot their arrows around the ring at opposing game pieces. Shield bearers counteract the attack of an archer and "shield" all game pieces grouped at the same game piece area. Individual battles or skirmishes take place when one group of game pieces arrives at a game piece area occupied by an equal number of the other player's game pieces. When this happens, the first player to move another of his game pieces into the battle areas so that he outnumbers the other player, wins the battle. To help in this situation, a free running scout is available which can move at will between contiguous game piece areas and does not have to follow the normal progression required of the other game pieces as they move around the rings.

An opposing player's game pieces may also be captured by a catapult which can be positioned circumferentially around the outer ring and "throw" radially inward across the rings by a number corresponding to the roll of the dice. The catapult has a much more limited range to shoot at than the archer but there is no protection from its missles.

Units of up to three game pieces may be formed and moved from game piece area to game piece area as would a single game piece. These units may land on and coalesce with other of the same player's game pieces into a "station" which serves as a waiting trap for another player's units, should they land on the station. As a unit would be outnumbered by a station, the opposing player's game pieces are immediately captured. A station therefore blocks a player's advance until he throws a proper roll on the dice to enable him to move over a station. A player can block the other player's advance even further by forming a barricade or three successive game piece areas each having three or more game pieces thereon which serves as an absolute bar on further advance by the opposing player's game pieces. A barricade instead must be attacked by the archer, catapult, or individual battles caused by moving game pieces into the barricade.

The playing surface is arranged in a series of concentric rings with one game piece area being specially designated as a starting or entry game piece area and its adjacent game piece area being designated as an advancement area from which game pieces move into the next innermost ring. Each player has his own designated game piece areas on each ring which staggers the start and advancement for each player. This helps eliminate any immediate congestion or capture as the players traverse the rings and advance radially inwardly. Captured players are moved off the board and can be reintroduced into play only by a player rolling doubles with the dice.

The object of the game is to move a designated game piece, the king, from the outer ring and through the many pitfalls set up by the opposing player on his way to the inner fortress. As the king is the last game piece which can be started into play, the opposing player has an opportunity to establish a strong defensive posture and lay in wait for the king. Alternately, a player could choose to set up minimal defenses and instead rely on his swift movement of his king onto the board before the other player establishes a defense and thereby achieve a quick victory. Of course, there are all sorts of strategies which might be successful in a particular situation, and the applicant's game lends itself to the development of these strategies. Thus, a successful player may follow a different tact depending upon the arrangement of the game pieces on the board.

As can be appreciated, applicant has developed a board game with apparatus and a method of play which fits right into the chosen theme of ancient combat. The shape of the game pieces, their movement, and the strategies help to simulate this theme and therefore provide a unique game heretofore unknown in the prior art. Applicant has given a brief overview of his game which is more completely described in the drawings and preferred embodiment which follows.

DETAILED DESCRIPTION OF THE PREFERRED EMBODIMENT

Figure 1:
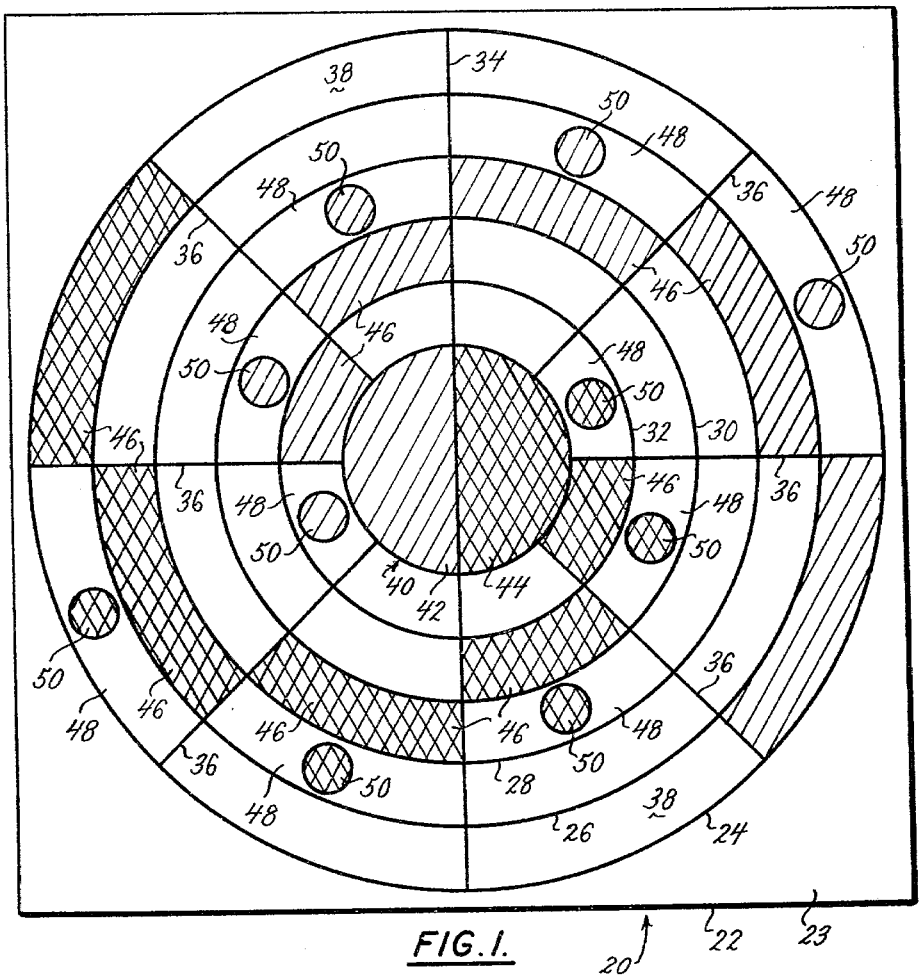
FIG. 1 is an overhead view of the game board.

Applicant's board game 20 includes a game board 22 shown in FIG. 1 with a playing surface 23 having five concentric rings numbered 24 through 32. One vertical line 34 and six radial lines 36 divide each of these rings 24–32 into eight game piece areas 38. An inner circle 40 is divided into two semicircles 42, 44 by vertical line 34.

Each ring 24–32 has a first designated game piece area 46 which represents a starting position or advancement position for movement into that particular ring. Each player has his own start/advance game piece area 46 where he moves into the next ring 24–32, the respective start/advance areas 46 for the two players being on opposite sides of the ring 24—32. The start/advance areas 46 are colored to correspond to each player.

Immediately counterclockwise from each start/advance area 46 is a designated finish game piece area 48. These finish areas 48 are designated by circles 50 colored to correspond to the start/advance areas 46 to aid in distinguishing them from the other player's corresponding areas. Similarly, each semi-circle 42, 44 is colored to match the start/advance areas 46 and finish areas 48, and represent the inner fortress or final position in the progression of inward movement from the outer ring 24. As is evident from the foregoing, movement begins at the outer ring 24 and continues in a clockwise direction until each game piece area 38 has been passed over in that particular ring. At that point, a player advances into the next innermost ring and lands on or passes by each game piece area 38 within that particular ring before moving inwardly again. Thus, although the players begin their movement at opposite sides of the playing surface 23, they must traverse each game piece area 38 contained on that surface 23 before they reach their respective inner fortress or semi-circle 42, 44.

Figure 2:
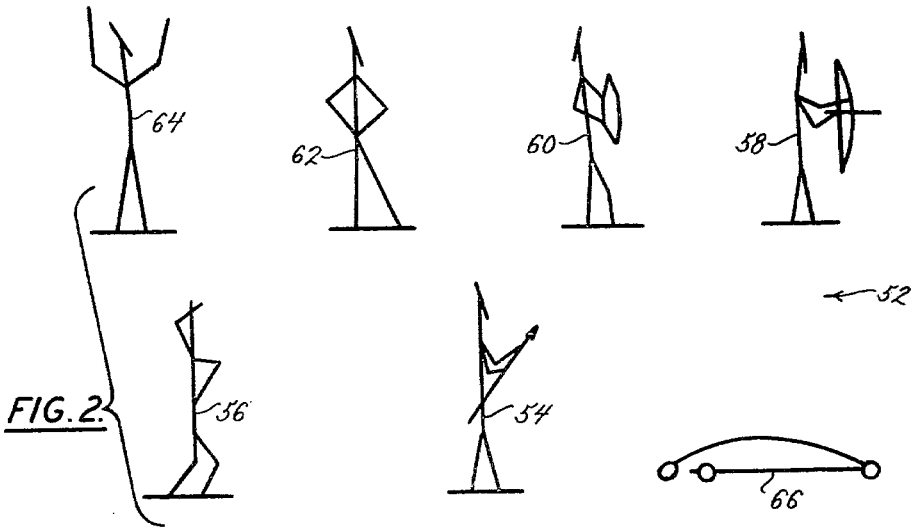
FIG. 2 depicts the individual game pieces used in playing the game.

The game pieces 52 are shown in FIG. 2 and include a warrior 54, a scout 56, an archer 58, a shield bearer 60, a captain 62, a king 64, and a catapult 66. These game pieces 52 are miniature statuettes or stick figures which may be formed from welded metal rods or the like. As can be seen from the drawing, they are designed to resemble their respective roles in the game. Each of these game pieces 52 except for the scout 56 and catapult 66 are moved onto the game board at the start/advance area 46 and move around the playing surface 23 as described above. The scout 56 is moved onto the playing surface 23 at the outermost start/advance area 46, but from that point may move to any contiguous game piece area 38 with no other restriction. The catapult 66 is never placed on the playing surface 23 but instead is placed in position around the circumference of the outer ring 24 and is used to fire radially inward at opposing player's game pieces 52 in an attempt to capture them. As explained in more detail hereinafter, a player may choose to take a chance with the catapult 66 in lieu of taking his regular turn.

In a somewhat similar manner, the archers 58 may be used to capture opposing player's game pieces 52. However, an archer fires his arrows around the particular ring 24–32 within which he is positioned. A shield bearer 60 positioned along the same ring as an opposing player's archer 58 will shield all of his game pieces 52 contained on that particular game piece area 38 and prevent capture by the opposing archer 58. Thus, while the archer 58 may fire in either direction around the ring and thus be a greater threat, his threat may be nullified by a shield bearer 60 carefully positioned to guard other game pieces 52. Not shown, but well known in the art, are two pairs of dice for playing of the game. One pair of dice consists of two dies, each of which has six sides numbered one through six. The second pair of dice consists of two dies, each of which has six sides numbered one through five with a blank side representing a wild card and the player may choose any number from one through five upon rolling this blank side. The second set of dice are used when a player chooses to use his archers or the catapult.

METHOD OF PLAY

At the beginning of the game, each player is assigned eight warriors, three scouts, three archers, two shield bearers, two captains, and one king. Each player then lines up his pieces across the game board and in the order mentioned in readiness for the start of play. The player to move first is chosen by a throw of the dice. The first player then makes an opening roll. He may move one warrier onto the board for the total of the two die; or two warriers onto the board, each moving to correspond with an individual die. Play then passes to the other player who duplicates the opening move of the first player. On successive moves, a player may choose to advance game pieces already on the board or introduce additional game pieces in the manner just described. However, a player must eventually introduce all of his game pieces into play as the object of the game is to move the king through the playing surface and into the inner fortress.

Movement along the board is as described above, except for the scouts, archers, and the catapult which is not assigned but instead is held in reserve for use by either player as an alternative to moving. This is described in more detail later. As game pieces are introduced into play, they may be moved into game piece areas already occupied by a player's own game pieces. To encourage this, players may be allowed to form "units" which may move together from just one roll of the dice. Up to three players may form a unit and be moved simultaneously. Of course, it is an advantage to form units and move players through the playing surface in this manner. If a player should move one or more game pieces into an area occupied by a higher number of opposing player's game pieces, then an immediate capture of the fewer number of game pieces is made and they are removed from the board. If an equal number of game pieces land, then a battle is declared and the player who next moves one or more pieces into that area captures the other player's pieces and wins the battle. Most useful in winning a battle is movement of the scout which, as described above, may move across rings and around barricades to arrive at a battle area and win the battle.

Game pieces may also be captured by use of the archer and catapult. If a player desires to use his archers, he must announce this before rolling the dice as a separate pair of dice are used having a blank side on each die. A player then rolls the special dice and all archers occupying positions on the playing surface are considered to be operative and capable of movement. A player may move one archer for each die or both dice, at his choosing. Furthermore, each archer may fire along his ring in either the clockwise or counterclockwise direction, as determined by the player making the roll. Should a player roll a blank side up, he may choose any number from one to five and move an archer any number of game piece areas from one to five either in the counterclockwise or clockwise direction. An archer captures an opposing player's game pieces by landing on a game piece area occupied by said opposing game pieces whereupon they are removed from the board. A shield bearer protects all of the game pieces on the same game piece area from capture by an archer.

A catapult may also be selected as an alternate move and must also be announced before the dice are rolled. Once again, the special dice are used after the catapult has been moved around the circumference of the outer ring and aimed inwardly at the five concentric rings. The catapult has thus an opportunity of throwing a missile on one game piece area located between the inner fortress and the catapult. The special dice are rolled and the catapult may capture opposing player's positioned the number of game pieces away from the catapult as corresponds to the number shown on the die. As before, captured game pieces are removed from the playing surface and may be re-introduced into play on a player's next turn.

Any captured game piece may be re-introduced by rolling doubles on the dice. The captured game piece moves the number of game piece areas corresponding to one die of the doubles. Captured game pieces may be re-introduced before a player has moved all of his game pieces onto the board the first time. Thus, a player may position and re-position all of his men, including captured men, before he may choose to move his king onto the playing surface.

As part of the defensive formations permitted in the game, a player may form either a station or a blockade, or a combination of both. A station is a game piece area which is occupied by more than three game pieces. Thus, an opposing player who moves a unit of game pieces into a station is immediately captured and removed from the board. A barricade consists of three consecutive game piece areas each occupied by at least three game pieces. An opponent arriving at a station may be able to jump over the station by making the proper roll with the dice. However, such a jumping move is not permitted to pass around the barricade. A player cannot move through a barricade under any circumstance and instead must break it down by attack. A player may attack a barricade by using his archers, the catapult, or individually declaring a battle on one of the game piece areas included in the barricade. Of course, if a player establishes more than three game pieces at each of the three locations, then an opposing player must use a catapult or archer to attack the barricade. Furthermore, if a player positions a shield bearer at two of the three game piece areas (each player having only two shield bearers), then only the third game piece area may be attacked by an archer while a catapult may be used against all three. This type of barricade is particularly difficult to destroy and may stymie advancement of the other player's king or game pieces while the barricading player picks them off with his own archers, catapult, and traveling units.

While it is not particularly desirable to make wasted moves, a player may move his game pieces all the way into the inner fortress at which point they are removed from the board and must be re-introduced into play as a captured player by throwing doubles on the dice. However, this does permit the option of repositioning a player's game pieces from the inner rings into the outer rings.

As mentioned above, the object of the game is to move the king through the series of concentric rings and into the inner fortress. To achieve this, all sorts of strategies may be used including holding the king back from play until the other game pieces have been defensively positioned and the other player moves his king onto the board. At that time, the other player's king can be attacked and moved off the board, requiring that player to roll doubles to move him back on. Captured game pieces may only be moved back onto the board in the order at which they are captured. Therefore, there may be several game pieces already captured, requiring a player to roll several sets of doubles before his king may be moved back onto the board.

Of course, there are a wide number of strategies available to a player which depend only upon his imagination and skill.

Various changes and modifications would be apparent to one of ordinary skill in the art upon a reading of applicant's disclosure. These changes and modifications are included in applicant's invention as part of his teaching and applicant intends that he be limited only by the scope of the claims appended hereto.

I claim:

1. A method for playing a game, said game having a game board with means defining a playing surface thereon, said playing surface including a plurality of concentric rings and a circular inner area, means dividing each of said rings and said inner circle into a plurality of game piece areas, at least two groups of game pieces and a pair of dice, the method comprising the steps of:

assigning a group of game pieces to each player;

determining the player to play first;

starting play by the first player rolling the dice and moving at least one game piece onto the playing surface and around the outer ring a corresponding number of game piece areas from a designated starting game piece area;

continuing play by the second player rolling the dice and moving at least one game piece onto the playing surface and around the outer ring a corresponding number of game piece areas from a second designated game piece area;

traversing the playing surface by moving each game piece about each ring until said game piece advances to a designated game piece area in said ring, said game piece advancing from said designated game piece area into the next innermost ring and continuing its movement;

forming traveling units comprising a plurality of one player's game pieces by landing at least one game piece on the same game piece area as contains at least one other of said player's game pieces, said traveling units moving as one game piece about the playing surface;

declaring a battle by one player's game pieces landing on a game piece area occupied by another player's game pieces, the winner being the player who first amasses the greater number of game pieces on said game piece area;

capturing game pieces by winning a battle, said captured game pieces being removed from the playing surface;

returning captured game pieces to the playing surface by rolling doubles on the dice; and winning the game by moving a designated game piece through each of the rings and into the inner circle.

2. The method of claim 1 further comprising the steps of:

capturing an opposing player's game pieces by announcing an intention to use at least one designated capturing game piece positioned on the playing surface;

rolling the dice;

moving at least one designated capturing game piece either clockwise or counterclockwise around the ring in which it is situated a number of game piece areas corresponding to the roll of the dice; and removing from the playing surface as captured those game pieces contained in the game piece areas arrived at.

3. The method of claim 2 further comprising the steps of:

capturing opposing players game pieces by announcing an intention to use a second designated capturing game piece not positioned on the playing surface;

positioning said second designated capturing game piece about the outer ring so that a plurality of game piece positions are aligned radially inwardly therefrom;

rolling the dice; and removing from the playing surface as captured those game pieces contained in the game piece area selected as being located the number of game piece areas radially inward corresponding to the roll on one or both die.

4. The method of claim 2 or 3 wherein the game further comprises a second pair of dice, each die having at least one blank side, said second pair of dice being used when capturing with either of said first or second designated capturing game pieces, and further comprising the step of declaring a capture when one or more blank sides are rolled, said blank side being equal to any number contained on any other side of the die at the rolling player's option.

5. The method of claim 2 wherein at least one of each player's game pieces is designated as a shielding game piece and further comprising the step of preventing capture by said first designated capturing game pieces of any game pieces positioned on a game piece area occupied by one of said shielding game pieces.

6. The method of claim 1 further comprising the steps of forming a barricade by positioning at least three game pieces on each of any three consecutive game piece areas, said barricade blocking movement of another player's game pieces.

7. The method of claim 1 wherein at least one of each player's game pieces is designated as a free moving game piece and further comprising the step of moving said free running game piece freely between contiguous game piece areas without regard to rings as a player plays a roll on the dice.

8. The method of claim 1 further comprising the step of forming a station by positioning more than three game pieces on any one game piece area, said station thereby capturing any traveling unit landing thereon.

9. The method of claim 1 further comprising the steps of removing from the playing surface any game piece which advances into the inner circle except for the designated winning game piece, and selectively re-starting said game pieces in the same manner as captured game pieces.

* * * * *